US008065750B2

(12) United States Patent
Dassler et al.

(10) Patent No.: US 8,065,750 B2
(45) Date of Patent: Nov. 29, 2011

(54) CYCLING GLOVE SUPPORT AREA

(76) Inventors: Alfred K. Dassler, Hollywood, FL (US); Robert M. Schwartz, Miami, FL (US); Albert J. Hofeldt, Miami Beach, FL (US)

( * ) Notice: Subject to any disclaimer, the term of this patent is extended or adjusted under 35 U.S.C. 154(b) by 0 days.

(21) Appl. No.: 12/879,183

(22) Filed: Sep. 10, 2010

(65) Prior Publication Data

US 2011/0055995 A1 Mar. 10, 2011

Related U.S. Application Data

(60) Provisional application No. 61/241,063, filed on Sep. 10, 2009, provisional application No. 61/325,481, filed on Apr. 19, 2010.

(51) Int. Cl.
*A41D 19/00* (2006.01)

(52) U.S. Cl. ..... 2/161.1

(58) Field of Classification Search ..... 2/20, 163, 2/455

See application file for complete search history.

(56) References Cited

U.S. PATENT DOCUMENTS

| | | | | |
|---|---|---|---|---|
| 4,577,625 | A * | 3/1986 | Lohati et al. | 601/128 |
| 5,537,688 | A * | 7/1996 | Reynolds et al. | 2/20 |
| 5,771,901 | A | 6/1998 | O'Brien | |
| 5,794,275 | A * | 8/1998 | Donzis | 2/455 |
| 6,289,517 | B1 | 9/2001 | Minkow et al. | |
| 6,301,722 | B1 * | 10/2001 | Nickerson et al. | 2/455 |
| 6,453,477 | B1 * | 9/2002 | Bainbridge et al. | 2/455 |
| 6,589,891 | B1 * | 7/2003 | Rast | 442/1 |
| 6,618,860 | B1 | 9/2003 | Sullivan et al. | |
| 7,707,654 | B1 * | 5/2010 | Spence | 2/161.6 |
| 2008/0282438 | A1 * | 11/2008 | Boutaghou | 2/16 |
| 2008/0307559 | A1 * | 12/2008 | Wright | 2/161.1 |

FOREIGN PATENT DOCUMENTS

KR 10-0487752 B1 5/2005

* cited by examiner

*Primary Examiner* — Katherine Moran

(74) *Attorney, Agent, or Firm* — Robert M. Schwartz; Alfred K. Dassler

(57) ABSTRACT

A glove including a palm portion formed of flexible material. The palm portion has at least one support area. The support area having a plurality of ball shaped elements.

14 Claims, 9 Drawing Sheets

CYCLING GLOVE SUPPORT AREA

CROSS-REFERENCE TO RELATED APPLICATIONS

This application claims the benefit of U.S. Provisional Application Ser. No. 61/241,063, filed on Sep. 10, 2009, entitled Cycling Glove and U.S. Provisional Application Ser. No. 61/325,481, filed on Apr. 19, 2010, entitled Cycling Glove, the prior applications are herewith incorporated by reference in their entirety.

BACKGROUND OF THE INVENTION

1. Field of the Invention

The invention relates to a support surface for use in a riding glove, more specifically, for padding in a bicycle/motorcycle riding glove that can be worn on the hand of a user for contacting a handle bar while riding.

2. Description of the Related Art

Existing cycling gloves typically are made of leather, vinyl and nylon and include a Velcro® closure for securing the glove to the hand. Many gloves include cushion members or padding on the palm area of the hand. The padding is usually made of foam or gel enclosed between the layers of the palm of the glove.

The disadvantages of existing padding in cycling gloves is that the cushion members are constructed to be very soft (in the range of hardness on the Shore OO scale) and become easily compressed between the user's hands and the handlebars of the bicycle. The cushion offers no support and thus often causes numbness in the hands and fingers of the rider and over time possible nerve damage to the rider's hands. Numbness may typically be caused by the pressure generated on the hand by the handle bars while riding. Additionally, the handlebars compress and deform the padding because of the small contact area of the handlebar on the glove. This further deteriorates the ability of the glove to protect the hand from the handlebars. Particularly, the handlebars of most bicycles are round metal or carbon fiber bars. The handlebars may be covered with a foam or cushion tape or elastic handlegrips that attempt to reduce the hardness of the bar with respect to the rider's hands. However, the use of cushioning on the bar or glove is not a successful solution, as evidenced by the high number of riders that experience continued numbness/tingling in the hands and or fingers during and after riding. Accordingly, a long-standing problem for cyclists is the problem of numbness/tingling in the hands and fingers when riding for extended periods of time.

SUMMARY OF THE INVENTION

It is accordingly an object of the invention to provide cycling gloves which overcome the above-mentioned disadvantages of the heretofore-known devices and methods of this general type and which provides cycling gloves that are comfortable.

With the foregoing and other objects in view there is provided, a glove including a palm portion formed of flexible material. The palm portion has at least one support area. The support area having a plurality of ball shaped elements.

In accordance with another feature of the invention, the plurality of ball shaped elements are disposed in a matrix pattern.

In accordance with an added feature of the invention, the palm portion is constructed of at least two layers. The ball shaped elements are disposed between the at least two layers.

In accordance with an additional feature of the invention, the ball shaped elements are disposed in rows within flexible sleeves.

In accordance with yet an additional feature of the invention, the ball shaped elements are interconnected by flexible strings passing through the ball shaped elements.

In accordance with yet another added feature of the invention, the glove includes a cavity defined at least partially by the palm area for receiving a human hand. A continuous padding layer is disposed between the cavity and the ball shaped elements.

In accordance with still another added feature of the invention, the ball shaped elements each have a respective center and diameter. Directly adjacent ones of the ball shaped elements are disposed with the centers spaced apart by a distance less than twice the diameter.

In accordance with yet still another added feature of the invention, at least some of the directly adjacent ball shaped elements directly contact one another.

In accordance with yet still another further feature of the invention, at least some of the ball shaped elements are hemispherical.

With the objects of the invention in view, there is also provided a padded glove including a glove body formed with a cavity for inserting a human hand and having a palm wall for covering a palm of the hand. A padding structure is mounted to the palm wall for padding the palm and preventing or alleviating fatigue of the palm caused by extended pressure on the palm of the hand. The padding structure is constructed of a plurality of interconnected spherical shaped structures which together define, a pliable support element.

In accordance with still a further feature of the invention, at least some of the interconnected spherical shaped structures are hemispherical projection substantially disposed in a matrix pattern.

In accordance with still another feature of the invention, the spherical shaped structures are a multiplicity of balls interconnected to one another with a connection defining flexible interconnectors for enabling the padding to be flexibly bent.

In accordance with yet an additional feature of the invention, the spherical shaped structures are formed of a material having a shore hardness of 50-95 Shore A.

In accordance with yet an added feature of the invention, the palm wall is a double wall with an inner layer and an outer layer. The padding structure is disposed between the inner layer and the outer layer.

In accordance with yet a further feature of the invention, the double wall is formed with a plurality of pockets between the inner layer and the outer layer, and each the pocket is filled with a respective the padding structure.

In accordance with yet a further feature of the invention, the padding structure is configured and maximized for supporting the hand on a handle bar.

With the foregoing and other objects in view there is provided a cycling glove including a support region having a plurality of spaced apart ball shaped support elements arranged in close proximity to one another. One or more support regions are arranged on the palm portion of the glove, the support regions have the ball shaped support elements held in place by tubular arrangements. The tubular arrangements are disposed side by side such that each ball is adjacent one or more other balls. The balls create a protective barrier between the hand and the handlebar or wherever the hand is placed.

Additionally, there is provided, in accordance with the invention, a cycling glove including a support region defined by a plurality of rigid plate or ball-shaped support elements.

The support elements may be interconnected to one another by flexible connectors, or arranged independent of one another but held in close relationship.

In one embodiment of the glove the support area conforms to the shape of a handlebar with a small surface area and distributes the load over a larger surface area. The glove is also very suitable for use in other activities such as weight lifting exercise where heavy amounts of weight are supported by the palms of the hands, such as bench presses, military presses or other exercises in which a bar supported by the palm of the user's hand. The support region allows the heavy weight load to be distributed more evenly over the palm. Additionally, the glove is flexible enough so that it is comfortable to wear and provides a responsive feel to the user. The hinge construction of the support regions allows the hands of the rider to be comfortably positioned with any orientation relative to the handle bars or any position on the handlebars.

Other features which are considered as characteristic for the invention are set forth in the appended claims.

Although the invention is illustrated and described herein as embodied in the cycling glove, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
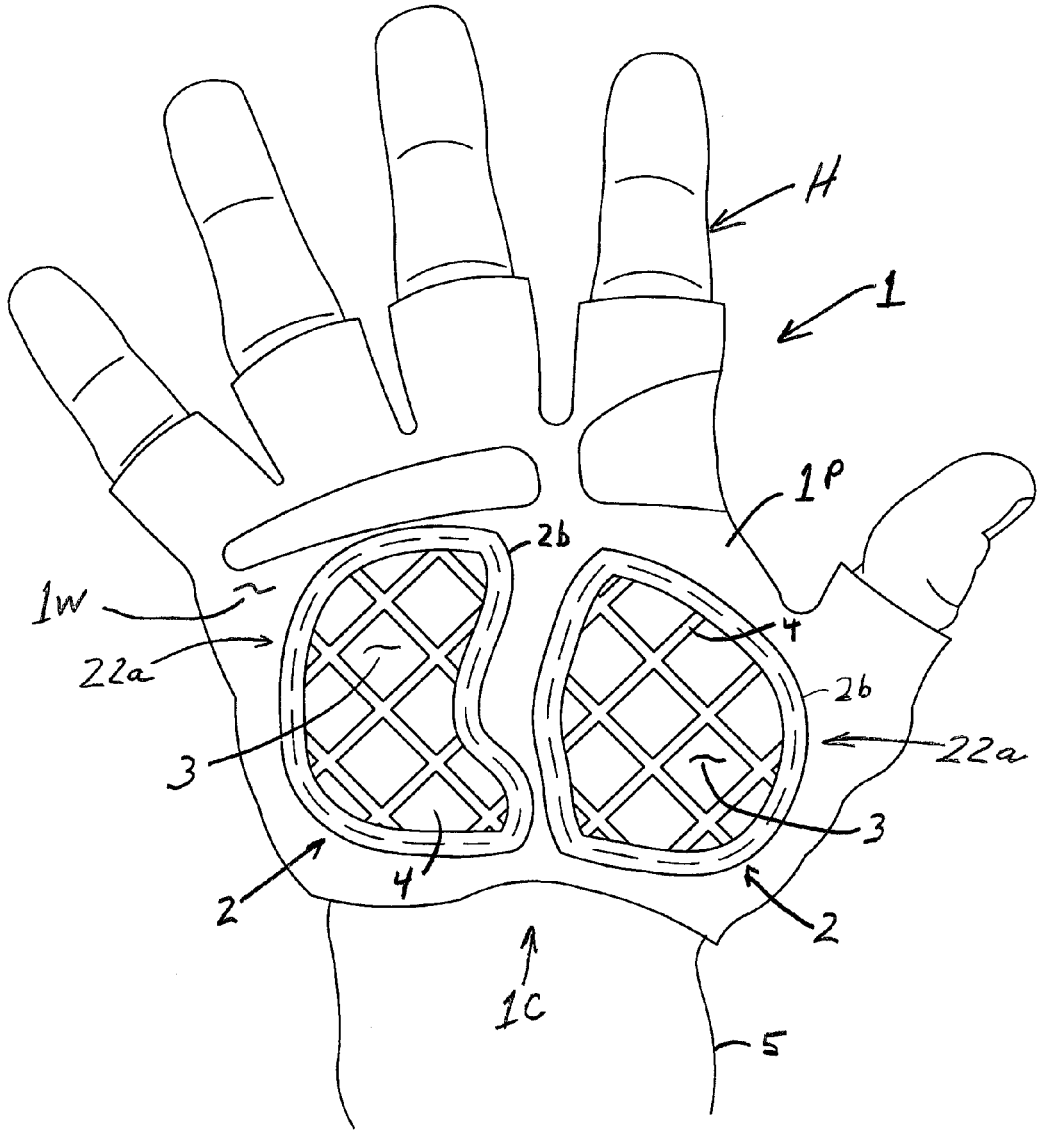
FIG. 1 is a plan view of a first embodiment of the glove with a portion of the outward facing layer omitted.
Figure 2A:
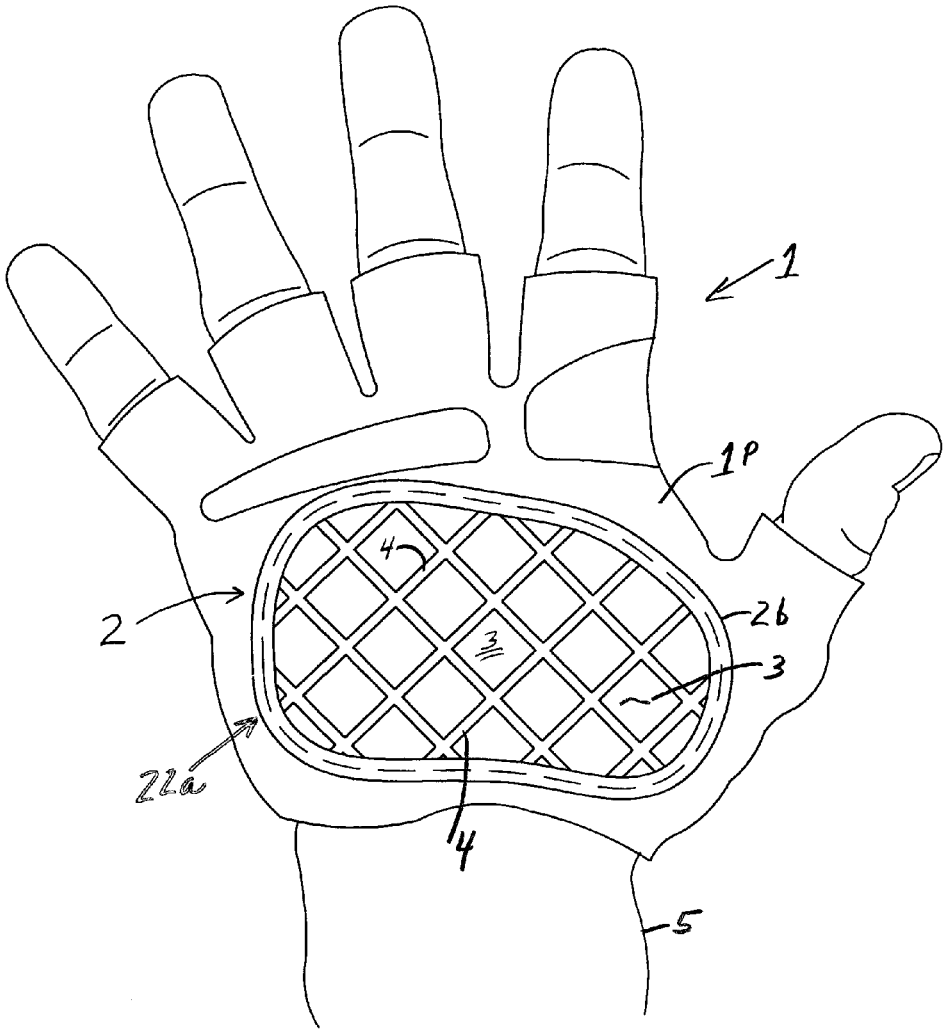
FIG. 2A is a plan view of another embodiment of the glove with a portion of the outward facing layer omitted.
Figure 2B:
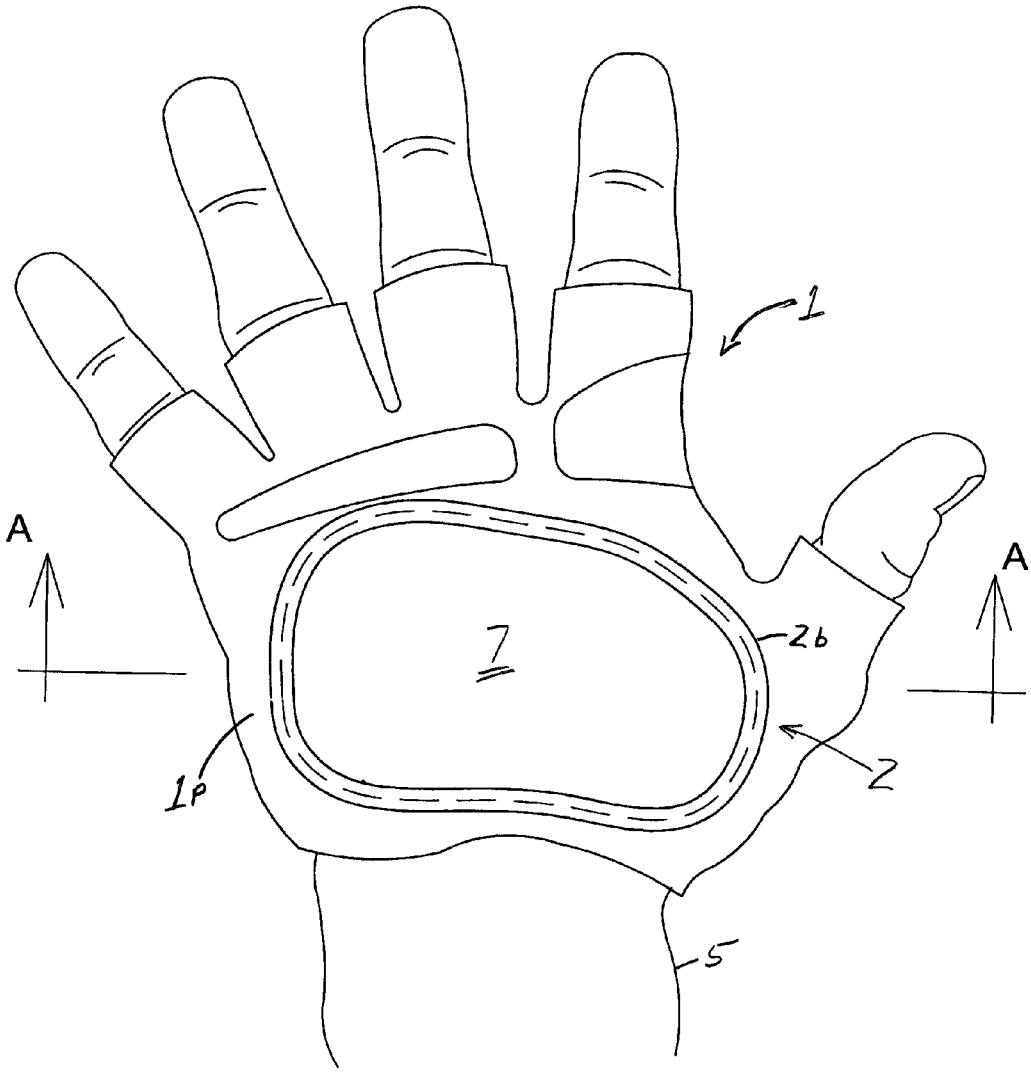
FIG. 2B is a plan view of the glove with the outward facing layer shown.

Referring now to the figures of the drawing in detail and first, particularly, to FIGS. 1 and 2 thereof, there is seen a glove/glove body 1 according to the invention. The glove 1 includes support regions 2 which are defined by a plurality of rigid plate elements 3 that are interconnected by a hinge 4 such as a living hinge. The support region(s) 2 are disposed at a palm area/portion 1*p* of the glove 1, which corresponds to a palm of a user's hands. The palm area 1*p* may have a circumferential border 2*b*. The glove 1 includes a cavity 1*c* for receiving a user's hand H. The cavity is at least partially defined by a palm wall 1*w*. The rigid plate elements 3 may be formed of plastic having a durometer of between 50 and 150 on the Rockwell R scale, which includes materials such as polypropylene, nylon, and polystyrenes etc. The use of the hinge 4 permits the support region 2 to flex, which prevents the support region 2 from pulling on other parts or areas of the glove 1 such as the area along the wrist 5 of a user when the glove 1 is placed against a handlebar 20. The hinge 4 further permits the support region 2 to contact the handlebar 20 with a larger surface area than a support region without hinges 4.

As discussed above, the hinge 4 may be provided as a living hinge (a hinge which results from a thinned portion of the material of the plate elements 3 as a result of injection molding). Alternatively, the hinge 4 may be provided by securely affixing the plate elements 3 to a fabric substrate. It is necessary that the hinge 4 is flexible enough to allow the plate elements 3 to conform or adjust to the handle bar 20 and a hand of a user wearing the glove 1. The conforming of the plate elements 3 allows the support region 2 to distribute the small area of pressure created at the handlebar 20 over a greater surface area without causing the glove 1 to be pulled uncomfortably in other areas or causing a Velcro® closure of the glove 1 to have extra stresses. Although the hinges 4 are shown aligned at right angles, it is possible to adjust the layout or orientation of the hinges 4 for different types of handlebars 20 (handlebars with different orientations with respect to the user, road bike handlebar, mountain bike handlebar, etc.) so that the flex of the support region 2 is as comfortable as possible. It is also possible for the plate elements 3 to have a more than four sides with hinges (polygonal or round/hemispherical) so as to provide flexibility in more directions and allow the glove to better conform in more directions.

The support regions 2 are sandwiched between an outer layer 7 such as leather or synthetic leather, which faces the handlebar 20 and a padding layer 8 (gel, foam, etc.) facing the hand of the user (between the support regions 2 and the cavity 1*c*. The padding layer 8 has an inner layer 9 such as leather or a synthetic layer, which defines the cavity 1*c* of the glove which directly contacts the hand of the user. The support region 2 allows the pressure of the handlebar 20 against the hand to be distributed to a larger surface area, which in turn allows the padding layer 8 to conform to the hand and not the handlebar 20. This prevents the padding layer 8 from wearing too quickly, as the padding actually pads the hands and not the handlebar. It is also possible to eliminate the padding layer 8 and to have the backside of the plate elements 3 directly contact the inner layer.

Figure 3:
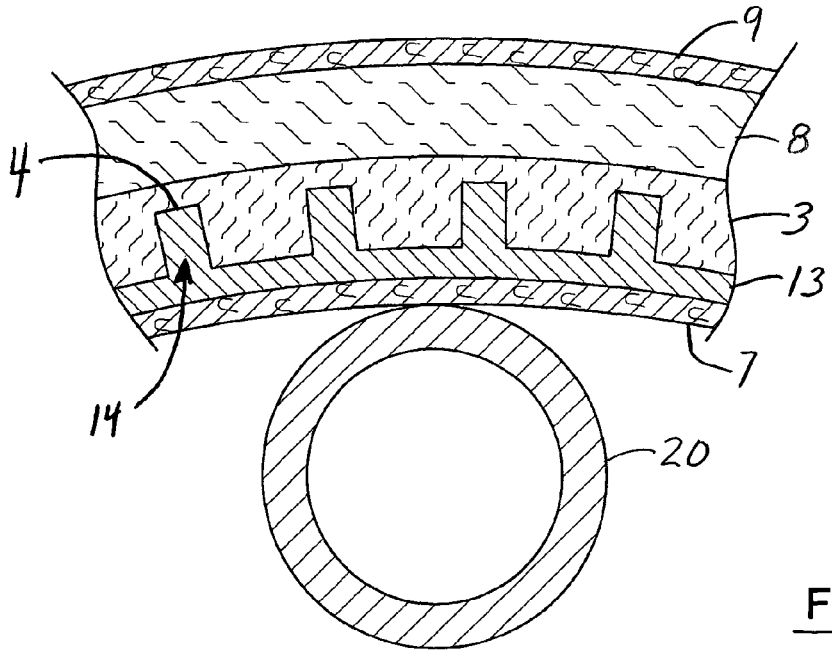
FIG. 3 is a cross-sectional view of the glove as it conforms to a handlebar.
Figure 4:
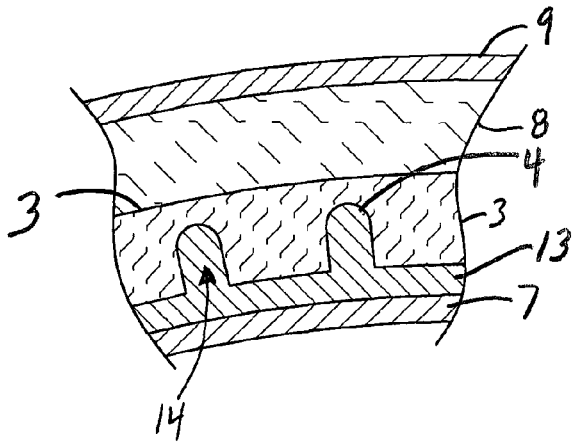
FIG. 4 is a partial cross-sectional view of another embodiment of the glove.
Figure 5:
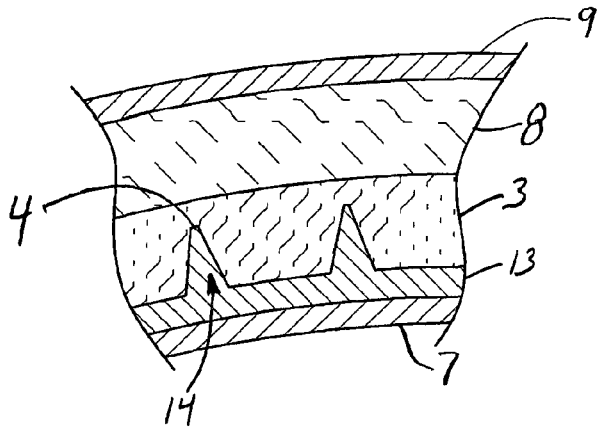
FIG. 5 is a partial cross-sectional view of a further embodiment of the glove.

When the hinge 4 is a living hinge, gaps 14 are provided between the individual plate elements 3 of the support region 2. The gaps 14 as shown in FIG. 3 have a rectangular shape. However, it is possible for the gaps 14 to have a triangular cross section with a radius at the top, in other words at the end of the gap 14 abutting the hinge, as shown in FIG. 5. Alternatively, a radius may be provided at the top of the rectangular shape to define that end of the gap, as shown in FIG. 4. Otherwise, corner radii can be provided in the corners of the rectangular shape.

Figure 6:
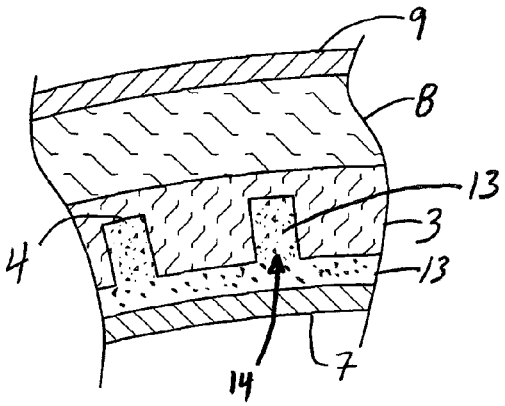
FIG. 6 is a partial cross-sectional view of a yet another embodiment of the glove.
Figure 7:
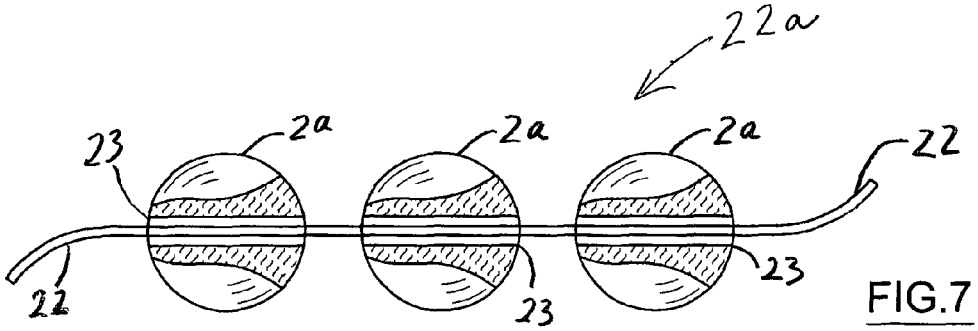
FIG. 7 is an enlarged partial cross-sectional view of still another embodiment of support elements.

In the case when a living hinge is provided as the hinge 4 it is possible to fill the gaps 14 of the support region 2 with an elastic material 13 such as a thermoplastic elastomer, gel, or rubber, as is shown in FIG. 6. Filling the gaps in this way reduces the flexibility of the support region 2, as the material 13 in the gaps 14 must be compressed to allow the hinge to flex. The filling of the gaps 4 also limits the travel of the individual plate elements 3, which results in increasing the durability of the support region 2. Also, in order to fill the gaps 14 it is possible for the elastic material 13 to be a continuous layer over the side of the support region 2 which faces the handlebar 20, in other words the areas of the support region 2 between the hinges 4.

FIGS. 7, 8, 9, and 11 to 13 illustrate another embodiment of the present invention. Here, the support regions 2 are provided with a plurality of discrete ball, round, or spherical shaped elements 2*a* disposed in a palm area 1*p* of the glove 1. The spherical shaped elements 2*a* can be considerably harder than conventional gel or foam cushion elements. A hardness value over 20 Shore A for the spherical shape elements 2*a* provides acceptable comfort and durability for the support regions. Preferably the hardness range for the spherical shape elements 2*a* is between 30 Shore A and 80 Shore D. A rubber ball shaped element 2*a* having a diameter of 4 to 6 mm and a hardness of 70 Shore A yielded favorable results in testing. Similarly a neoprene shaped element 2*a* having a diameter of 4 to 6 mm and a hardness of 87 Shore A yielded favorable results in testing. Surprisingly, it has been found in preliminary testing that the ball-shape of the support regions dramatically reduces numbness/tingling in the fingers of a user. The ball shaped elements 2*a* are illustrated as being substantially round, however it is also possible that they have an elliptical shape or have a flat side, such as a hemispherical. It is also possible that the ball shaped elements 2*a* can be pyramid shaped, triangular shaped, cube shaped, cylinder shaped, trapezoid shaped, parallelepiped shaped, tube shaped, bean shaped, capsule shaped or box shaped. The ball shaped elements may be disposed in other areas of the glove 1, such as areas corresponding to fingers of the glove 1.

Figure 8:
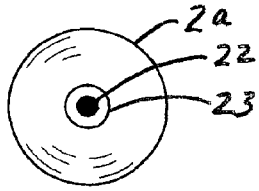
FIG. 8 is an end view of a support element of FIG. 7.
Figure 9:
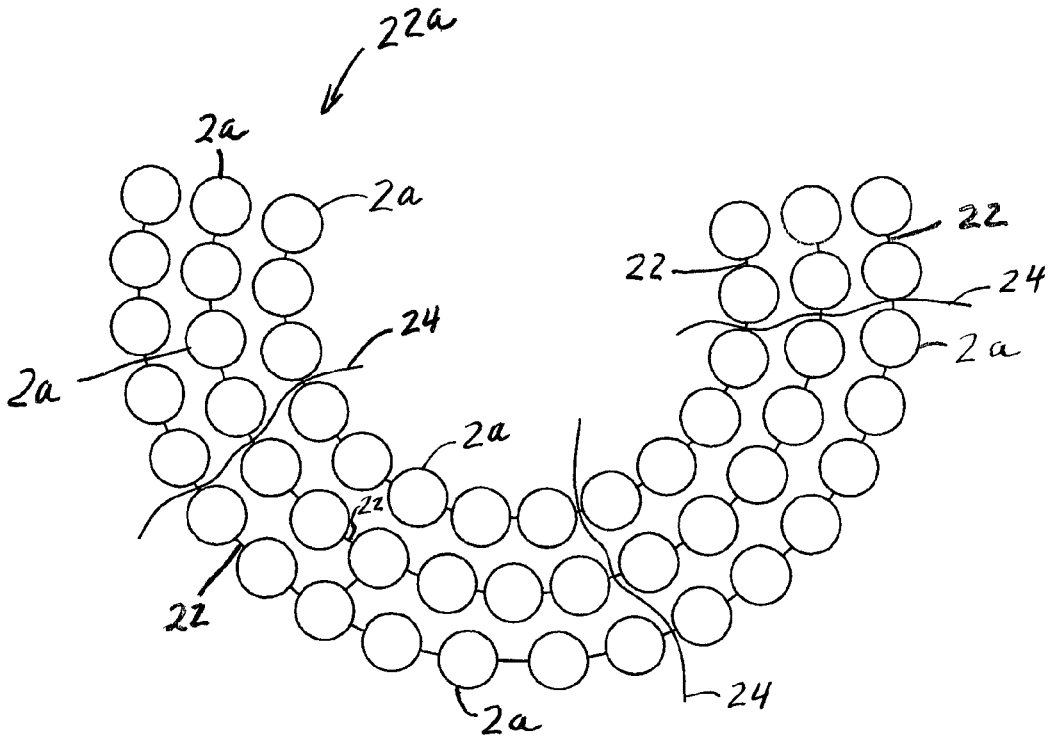
FIG. 9 is a plan view of an assembly of support elements using the support element shown in FIGS. 7 and 8.

The ball shaped elements 2*a* can be connected by a line or string 22 and disposed in a matrix pattern 22A within the support regions. The fact that the balls 2*a* are connected by the line 22 along with the shape of the ball shaped elements 2*a* allows exceptional movement between the ball shaped elements 2*a* which results in excellent flexibility of the glove thereby permitting the glove to conform to a handlebar without causing pulling of the glove in areas between the fingers. FIG. 8 shows that the balls 2*a* have a hole 23 allowing the line 22 to pass through and interconnect the ball shaped elements 2*a*. It is also possible for the ball shaped elements 2*a* to be molded directly onto the line 22 or onto a mesh pattern of lines 22. FIG. 9 shows an assembly of the ball shaped elements 2*a* constructed for being placed into the palm area 1*p* of the glove 1, wherein the support area 2 would be U-shaped. Additional lines or strings 24 are connected to and cross the lines 22 to prevent the ball shaped elements 2*a* from shifting and causing the lines 22 to cross one another. FIG. 9 also illustrates that the ball shaped elements 2*a* connected by the line 22 provides exceptional flexibility for constructing various shapes to accommodate specific support areas 2 of the glove 1. Other shapes can be recognized in the preceding figures of the instant application.

Figure 10A:
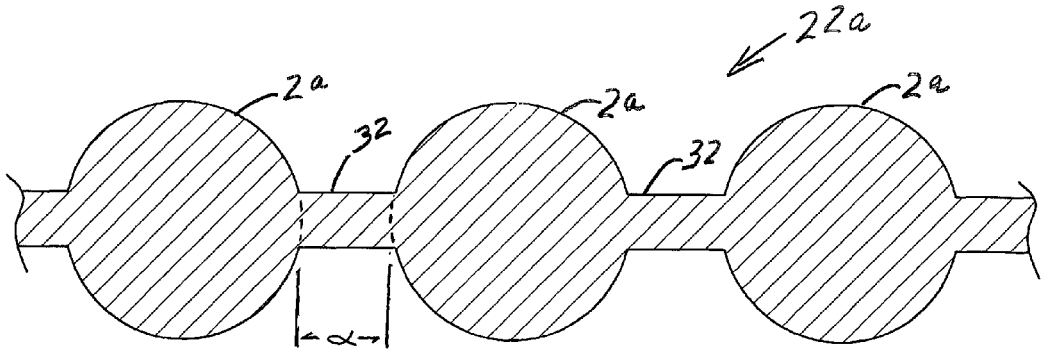
FIG. 10A is a partial cross-sectional view of yet another embodiment of support elements.
Figure 10B:
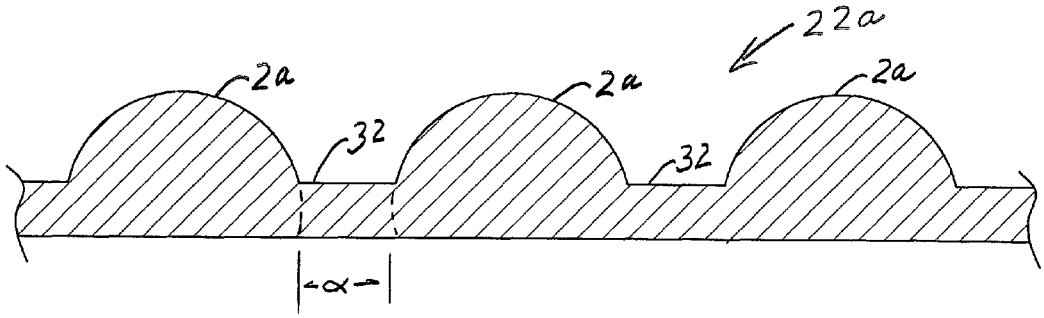
FIG. 10B is a partial cross-sectional view of a still yet another embodiment of support elements.

FIG. 10A shows that the ball shaped elements 2*a* are provided as hemispheres which can be molded as projections of a flexible substrate 32 in matrix pattern 22*a*, wherein the flexible substrate 32 is a living hinge between the hemispheres 2*a*. It is also possible for the hemispheres to only be provided on one side of the substrate 32 so that the opposite side of the substrate is smooth as shown in FIG. 10B. It is preferable that the hemispheres 2*a* be directed towards the cavity 1*c* which accommodates the user's hand H.

Figure 12:
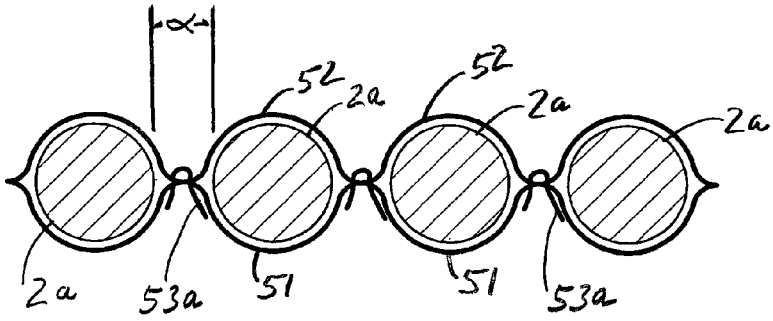
FIG. 12 is a sectional view along line 12-12 in FIG. 11.
Figure 11:
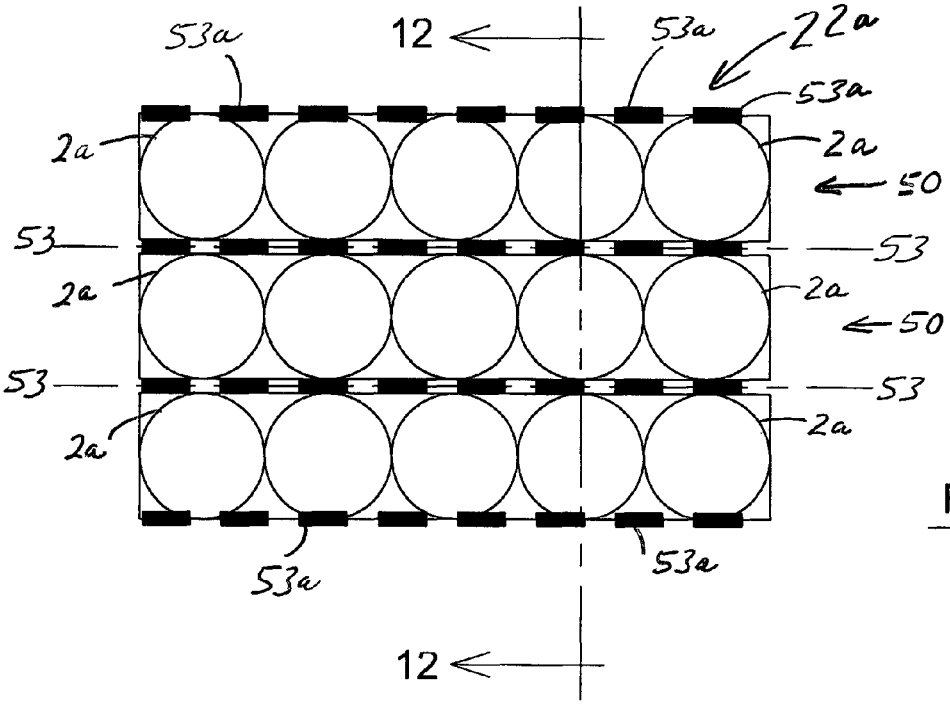
FIG. 11 is a plan view of an alternate embodiment of support elements inserted into tubes.
Figure 13:
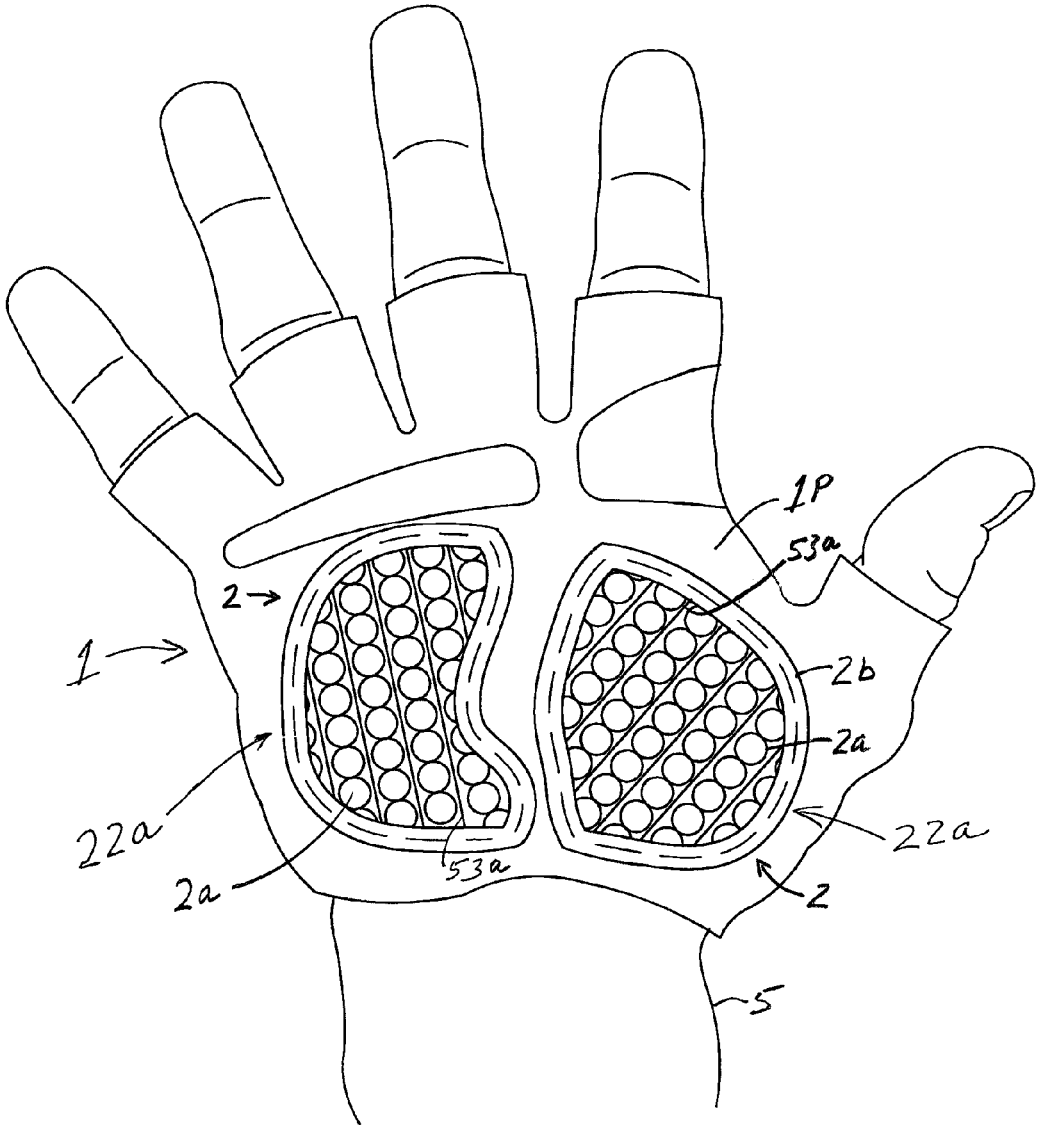
FIG. 13 is a plan view of the glove having the support elements of FIGS. 11 and 12 and the outward facing layer omitted.

FIGS. 11 and 12 show an alternate embodiment of disposing ball shaped elements 2*a* in flexible tunnels or tubes 50. The tunnel 50 has a diameter slightly greater than the diameter of spheres 2*a*. The tunnels 50 may be constructed by a first substrate 51 affixed to a second substrate 52 along longitudinal lines 53. This may be achieved by using stitching 53*a* to attach the first substrate 51 to the second substrate 52. In this embodiment, ball shaped elements 2*a* are inserted into tunnels 50 and the substrate 51 or 52 is attached to the glove 1 in desired areas or support areas 2, as is shown in FIG. 13. The attachment of the substrates 51 or 52 may be by an adhesive backing on the substrate 51 or 52, which affixes the matrix pattern 22*a* to retrofit a glove 1. Although not explicitly shown, the ball shaped elements 2*a* can also be disposed along with a padding layer 8 between an inner layer 9, and an outer layer 7, as described above with respect to the embodiments shown in FIGS. 3-5.

In the matrix 22*a*, at least some of the ball shaped elements 2*a* are disposed such that ball shaped elements 2*a* directly adjacent to one another are disposed such that the adjacent surfaces thereof are within a distance $\alpha$ of less than a diameter of the ball shaped elements 2*a* at the nearest point thereof. Preferably, the ball shaped elements 2*a* are disposed such that at least some of the ball shaped elements 2*a*, which are disposed directly adjacent to one another contact one another at a contact point/surface between the ball shaped elements 2*a*.

It is preferable for the ball shaped elements 2*a* to be a rubber, neoprene, thermoplastic elastomer or other elastomeric material. However, the ball shaped elements 2*a* may also be made of compressed rubber, plastic or other compatible materials which meet the hardness and durability requirements for the glove. It is also preferable that the ball shaped elements 2*a* of the diameter in the range of 2 mm-12 mm. Particularly, a range of 4 mm-8 mm has been found to be very effective.

We claim:

1. A glove comprising:

a palm portion formed of flexible material, said palm portion having at least one support area;

said support area having a plurality of spherical shaped elements, said palm portion being constructed of at least an inner layer and an outer layer, said spherical shaped elements being disposed between said inner layer and said outer layer, said spherical shaped elements being interconnected to one another with a connection defining flexible interconnectors for enabling said support area to be flexibly bent.

2. The glove according to claim 1, wherein said plurality of spherical shaped elements are disposed in a matrix pattern.

3. The glove according to claim 2, wherein said spherical shaped elements are disposed in rows within flexible sleeves.

4. The glove according to claim 2, wherein said spherical shaped elements are interconnected by flexible strings passing through said spherical shaped elements.

5. The glove according to claim 1, wherein said glove includes a cavity defined at least partially by said palm area for receiving a human hand, a continuous padding layer is disposed between said cavity and said spherical shaped elements.

6. The glove according to claim 1, wherein said spherical shaped elements each have a respective center and diameter, directly adjacent ones of said spherical shaped elements are disposed with said centers spaced apart by a distance less than twice said diameter.

7. The glove according to claim 6, wherein at least some of said directly adjacent spherical shaped elements directly contact one another.

8. The glove according to claim 6, wherein at least some of said spherical shaped elements are hemispherical.

9. A padded glove, comprising:

a glove body formed with a cavity for inserting a human hand and having a palm wall for covering a palm of the hand;

a padding structure mounted to said palm wall for padding the palm and preventing or alleviating fatigue of the palm caused by extended pressure on the palm of the hand, said palm wall being a double wall with an inner layer and an outer layer, said padding structure being disposed between said inner layer and said outer layer;

said padding structure being constructed of a plurality of interconnected spherical shaped structures together defining, a pliable support element, said spherical shaped structures being a multiplicity of balls interconnected to one another with a connection defining flexible interconnectors for enabling said padding to be flexibly bent.

10. The padded glove according to claim 9, wherein at least some of said interconnected spherical shaped structures are hemispherical projections substantially disposed in a matrix pattern.

11. The padded glove according to claim 9, wherein said spherical shaped structures are a multiplicity of balls.

12. The padded glove according to claim 9, wherein said spherical shaped structures are formed of a material having a shore hardness of 50-95 Shore A.

13. The padded glove according to claim 9, wherein said double wall is formed with a plurality of pockets between said inner layer and said outer layer, and each said pocket is filled with a respective said padding structure.

14. The padded glove according to claim 9, wherein said padding structure is configured and maximized for supporting the hand on a handle bar.

* * * * *